US010087719B2

(12) United States Patent
Tolman et al.

(10) Patent No.: US 10,087,719 B2
(45) Date of Patent: Oct. 2, 2018

(54) SYSTEMS AND METHODS FOR ARTIFICIAL LIFT SUBSURFACE INJECTION AND DOWNHOLE WATER DISPOSAL

(71) Applicants: Randy C. Tolman, Spring, TX (US); Michael C. Romer, The Woodlands, TX (US)

(72) Inventors: Randy C. Tolman, Spring, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 48 days.

(21) Appl. No.: 15/281,769

(22) Filed: Sep. 30, 2016

(65) Prior Publication Data

US 2017/0167229 A1 Jun. 15, 2017

Related U.S. Application Data

(60) Provisional application No. 62/266,216, filed on Dec. 11, 2015.

(51) Int. Cl.
*E21B 41/00* (2006.01)
*F04B 17/03* (2006.01)
(Continued)

(52) U.S. Cl.
CPC ..... *E21B 41/0057* (2013.01); *E21B 43/126* (2013.01); *E21B 43/129* (2013.01);
(Continued)

(58) Field of Classification Search
None
See application file for complete search history.

(56) References Cited

U.S. PATENT DOCUMENTS 6,196,312 B1 * 3/2001 Collins ..... E21B 41/0057 166/106
6,328,102 B1 12/2001 Dean
(Continued)

FOREIGN PATENT DOCUMENTS

EP 2 077 374 A1 7/2009
GB 2 393 747 A 4/2004
(Continued)

*Primary Examiner* — William D Hutton, Jr.
*Assistant Examiner* — Charles R Nold
(74) *Attorney, Agent, or Firm* — ExxonMobil Upstream Research Company-Law Department

(57) ABSTRACT

A method of disposing of fluids produced from a wellbore extending into a subsurface formation, the subsurface formation having a production zone and a disposal zone, at least a portion of the wellbore lined with a string of production casing. The method includes placing a wellbore tubular conduit within the casing; placing a pump in fluid communication with the wellbore tubular conduit, the pump having an inlet and a discharge, the inlet in fluid communication with a source of produced fluids; and injecting the produced fluids through a plurality of perforations positioned about the casing into a disposal zone of the subsurface formation. A system for disposing of fluids produced from a wellbore extending into a subsurface formation is also provided.

25 Claims, 5 Drawing Sheets

(51) Int. Cl.

| | |
|---|---|
| ***E21B 43/12*** | (2006.01) |
| ***E21B 43/38*** | (2006.01) |
| ***F04B 47/06*** | (2006.01) |

(52) U.S. Cl.

CPC ..... *E21B 43/385* (2013.01); *F04B 17/03* (2013.01); *F04B 47/06* (2013.01)

(56) References Cited

U.S. PATENT DOCUMENTS

| | | | |
|---|---|---|---|
| 7,111,675 | B2 | 9/2006 | Zisk, Jr. |
| 7,322,803 | B2 | 1/2008 | Vogeley |
| 7,484,940 | B2 | 2/2009 | O'Neill |
| 7,597,150 | B2 | 10/2009 | Clem |
| 8,133,041 | B2 | 3/2012 | Ludlow et al. |
| 8,220,533 | B2 | 7/2012 | Longfield et al. |
| 8,511,390 | B2 | 8/2013 | Coyle et al. |
| 2002/0197174 | A1 | 12/2002 | Howard |
| 2003/0010491 | A1 | 1/2003 | Collette |
| 2006/0198742 | A1 | 9/2006 | DiFoggio et al. |
| 2008/0080991 | A1 | 4/2008 | Yuratich et al. |
| 2009/0183879 | A1 | 7/2009 | Cox |
| 2009/0218091 | A1 | 9/2009 | Dotson |
| 2010/0012313 | A1 | 1/2010 | Longfield |
| 2012/0023606 | A1 | 1/2012 | Rehman |
| 2012/0076668 | A1* | 3/2012 | Bolt ..... F04B 15/02 417/53 |
| 2012/0093663 | A1* | 4/2012 | Foster ..... E21B 43/129 417/246 |
| 2017/0022796 | A1* | 1/2017 | Joshi ..... E21B 4/04 |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

* cited by examiner

SYSTEMS AND METHODS FOR ARTIFICIAL LIFT SUBSURFACE INJECTION AND DOWNHOLE WATER DISPOSAL

CROSS REFERENCE TO RELATED APPLICATION

This application claims the benefit of U.S. Provisional Application Ser. No. 62/266,216 filed Dec. 11, 2015 entitled, "Systems and Methods for Artificial Lift Subsurface Injection and Downhole Water Disposal," the disclosure of which is incorporated herein by reference in its entirety.

FIELD

The present disclosure is directed generally to systems and methods for artificial lift in a wellbore and more specifically to systems and methods that combine artificial lift with subsurface injection for downhole water disposal.

BACKGROUND

When first completed, many gas wells have sufficient reservoir pressure to flow formation fluids to the surface along with the produced gas. As gas production continues, the reservoir pressure declines, and as pressure declines, the velocity of the fluid in the well tubing decreases. Eventually, the gas velocity up the production tubing is no longer sufficient to lift liquid droplets to the surface. Liquids may then accumulate in the tubing, creating additional pressure drop, slowing gas velocity, and raising pressure in the reservoir surrounding the well perforations and inside the casing. As the bottom well pressure approaches reservoir shut-in pressure, gas flow may stop and liquids can accumulate at the bottom of the tubing.

At different stages in the life of a gas well, various means can be employed to move accumulated liquids to the surface. Traditionally, plunger lift and/or rod pump systems have been utilized to provide artificial lift and to remove this wellbore liquid from the hydrocarbon well. While these systems may be effective under certain circumstances, they may not be capable of efficiently removing the wellbore liquid from long and/or deep hydrocarbon wells, from hydrocarbon wells that include one or more deviated (or nonlinear) portions (or regions), and/or from hydrocarbon wells in which the gaseous hydrocarbons do not generate at least a threshold pressure.

As an illustrative, non-exclusive example, plunger lift systems require that the gaseous hydrocarbons develop at least the threshold pressure to provide a motive force to convey a plunger between the subterranean formation and the surface region. As another illustrative, non-exclusive example, rod pump systems utilize a mechanical linkage (i.e., a rod) that extends between the surface region and the subterranean formation; and, as the depth of the well (or length of the mechanical linkage) is increased, the mechanical linkage becomes more prone to failure and/or more prone to damage the casing. As yet another illustrative, non-exclusive example, neither plunger lift systems nor rod pump systems may be utilized effectively in wellbores that include deviated and/or nonlinear regions.

Improved hydrocarbon well drilling technologies permit an operator to drill a hydrocarbon well that extends for many thousands of meters within the subterranean formation, that has a vertical depth of hundreds, or even thousands, of meters, and/or that has a highly deviated wellbore. These improved drilling technologies are routinely utilized to drill long and/or deep hydrocarbon wells that permit production of gaseous hydrocarbons from previously inaccessible subterranean formations. However, wellbore liquids cannot be removed efficiently from these hydrocarbon wells using traditional artificial lift systems.

Electric submersible pumps (ESPs) and hydraulic submersible pumps (HSPs) offer high-volume pumping options available to industry. ESPs are commonly installed as part of the tubing string, which means they require a costly pulling rig for installation and replacement. HSPs are relatively newer to the industry and can be installed through-tubing. Micro positive displacement and solid state pumps are currently being developed for installation in field applications.

In artificial lift applications, water disposal at the surface can be problematic. For example, produced water may be corrosive, requiring the use of chemicals for treatment. Scaling may also occur. Off-site disposal can be costly, as well.

Therefore, there exists a need for improved systems and methods for artificial lift and disposal of wellbore fluids comprising water.

SUMMARY

In one aspect, disclosed herein is a method of disposing of fluids produced from a wellbore extending into a subsurface formation, the subsurface formation having a production zone and a disposal zone, at least a portion of the wellbore lined with a string of production casing. The method includes placing a wellbore tubular conduit within the casing; placing a pump in fluid communication with the wellbore tubular conduit, the pump having an inlet and a discharge, the inlet in fluid communication with a source of produced fluids; and injecting the produced fluids through a plurality of perforations positioned about the casing into a disposal zone of the subsurface formation.

In some embodiments, the disposal zone is above or below the production zone.

In some embodiments, at least a portion of the wellbore is completed along the subsurface formation in a horizontal orientation and forms a horizontal production zone. In some embodiments, the disposal zone is within the horizontal production zone.

In some embodiments, the pump is sized for placement and operation within the wellbore tubular conduit.

In some embodiments, the method further includes providing sufficient pressure to inject into the disposal zone.

In some embodiments, the method further includes powering the pump with a system comprising electrically driven solid state electronics or an electric motor.

In some embodiments, the method further includes returning the pump to the surface for service by pulling a cable or power cord that supplies electricity to it.

In some embodiments, the method further includes powering the pump by a system comprising the source of produced fluids.

In some embodiments, the method further includes returning the pump to the surface for service by hydraulic pressure.

In some embodiments, the hydraulic pressure is provided from the source of produced fluids.

In some embodiments, the source of produced fluids is obtained from a plurality of wellbores extending into the subsurface formation.

In some embodiments, the pump is selected from a micro positive displacement pump, a solid state pump or a hydraulically powered pump.

In yet another aspect, disclosed herein is a system for disposing of fluids produced from a wellbore extending into a subsurface formation, the subsurface formation having a production zone and a disposal zone, at least a portion of the wellbore lined with a string of production casing. The system includes a wellbore tubular conduit, the wellbore tubular conduit positioned within the casing; a pump having an inlet and a discharge, the pump in fluid communication with the wellbore tubular conduit; a driver operatively connected to the pump for driving the pump; a source of produced fluids in fluid communication with the inlet of the pump; and a plurality of perforations positioned about the casing, the plurality of perforations in fluid communication with the discharge of the pump, wherein the plurality of perforations provides a pathway for injecting produced fluids into the disposal zone.

In some embodiments, the disposal zone is above or below the production zone.

In some embodiments, at least a portion of the wellbore is completed along the subsurface formation in a horizontal orientation and forms a horizontal production zone. In some embodiments, the disposal zone is within the horizontal production zone.

In some embodiments, the pump is sized for placement and operation within the wellbore tubular conduit, the pump having sufficient pressure to inject into the disposal zone.

In some embodiments, the pump is powered by a system comprising electrically driven solid state electronics or an electric motor.

In some embodiments, the system further includes a cable or power cord for supplying electricity to the pump, the pump structured and arranged to return to the surface for service by pulling the cable or power cord.

In some embodiments, the pump is powered by a system comprising the source of produced fluids.

In some embodiments, the pump is structured and arranged to return the pump to the surface for service by hydraulic pressure.

In some embodiments, the hydraulic pressure is provided from the source of produced fluids.

In some embodiments, the source of produced fluids is obtained from a plurality of wellbores extending into the subsurface formation.

In some embodiments, the pump is selected from a micro positive displacement pump, a solid state pump or a hydraulically powered pump.

DETAILED DESCRIPTION

In FIGS. 1-5, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

FIGS. 1-5 provide illustrative, non-exclusive examples of assemblies, systems and methods for disposing of fluids produced from a wellbore, according to the present disclosure, together with elements that may include, be associated with, be operatively attached to, and/or utilize such assemblies, systems and methods.

Although the approach disclosed herein can be applied to a variety of subterranean well designs and operations, the present description will primarily be directed to systems for removing fluids from a well and/or disposing of such fluids.

Figure 1:
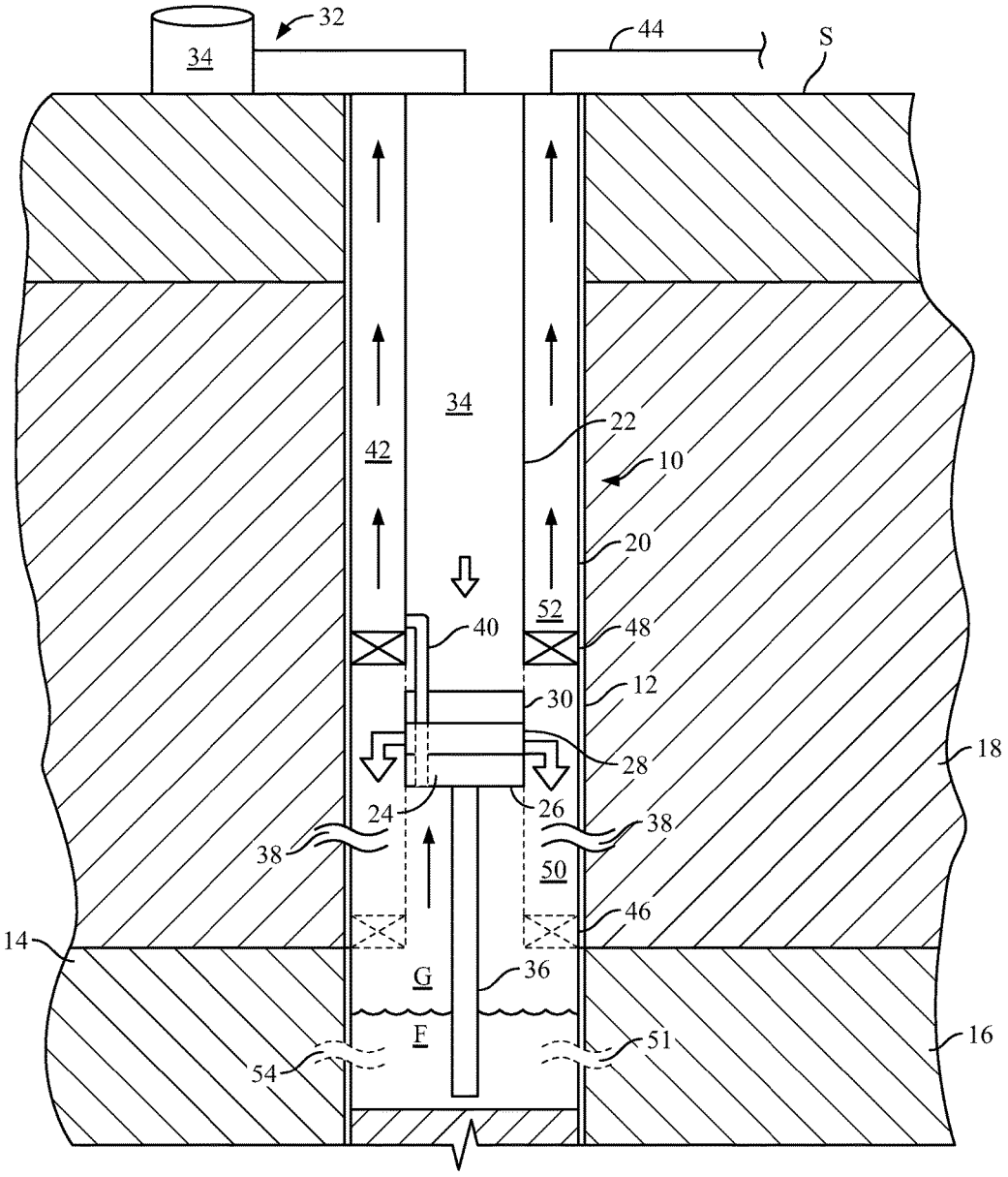
FIG. 1 presents a schematic view of an illustrative, nonexclusive example of a system for disposing of fluids produced from a wellbore, according to the present disclosure.

FIG. 1 presents, for illustrative purposes, a schematic view of a system 10 for disposing of fluids produced from a wellbore 12, in accordance with the present disclosure. As shown, wellbore 12 extends into a subsurface formation 14, the subsurface formation 14 having a production zone 16 and a disposal zone 18, at least a portion of the wellbore 12 lined with a string of production casing 20.

In some embodiments, system 10 includes a wellbore tubular conduit 22, the wellbore tubular conduit 22 positioned within the casing 20, as shown. In some embodiments, the wellbore tubular conduit 22 may serve as injection tubing. System 10 also includes a pump 24 having an inlet 26 and a discharge 28. As shown, the pump 24 may be structured and arranged so as to be in fluid communication with the wellbore tubular conduit 22. A driver 30 is operatively connected to the pump 24 for driving the pump 24. As shown, a primary source of produced fluids F is in fluid communication with the inlet 26 of the pump 24. In some embodiments, a dip tube 36 is employed to place inlet 26 in fluid communication with the primary source of produced fluids F.

In some embodiments, the driver 30 of pump 24 may be a hydraulic driver, which is powered by a system 32 comprising a secondary source of produced fluids 34, the secondary source of produced fluids 34 produced at least in part by one or more other wells of the subterranean formation 14.

In some embodiments, the pump 24 is sized for placement and operation within the wellbore tubular conduit 22, the pump 24 having sufficient pressure to inject into the disposal zone. 18. In some embodiments, the pump 24 is structured and arranged to return the pump 24 to the surface S by hydraulic pressure for service. In some embodiments, the hydraulic pressure is provided from the primary source of produced fluids F, or the secondary source of produced fluids 34.

System 10 also includes a first plurality of perforations 38 positioned about the production casing 20, the plurality of perforations 38 in fluid communication with the discharge 28 of the pump 24. As may be appreciated from a review of FIG. 1, the plurality of perforations 38 provides a pathway for injecting the primary produced fluids F into the disposal zone 18. Advantageously, system 10 may also be configured, as shown, so that the secondary source of produced fluids 34 that drive pump 24 may also be injecting into the disposal zone 18 through the plurality of perforations 38.

In some embodiments, the disposal zone 18 is above or below the production zone 16. Although not shown, but will be appreciated by those skilled in the art, the system 10 possesses utility in wellbores wherein at least a portion of the wellbore is completed along the subsurface formation in a horizontal orientation.

As may be appreciated, in some embodiments, both the production and injection or disposal of fluids may be carried out in the same horizontal orientation. An exemplary embodiment may encompass one or more horizontal well sections of up to about 3050 meters (about 10,000 feet) or more in length. By way of example, but not of limitation, if a toe down well was structured and arranged to encompass disposal at the toe and production at the heal, it would have the appearance or configuration of two vertical wells of up to about 3050 meters (about 10,000 feet) or more apart.

For the purposes of this disclosure, the use of the terms "production and disposal zones" may also encompass production and pressure support within the production zone.

Gas G produced from wellbore 12 enters inlet 26 of pump 24 and is discharged through gas discharge tube 40, through annulus 42, exiting wellbore 12 through gas conduit 44.

In some embodiments, system 10 further may include a sand control structure (not shown), which may be configured to limit the flow of sand into inlet 26 of pump 24.

In some embodiments, a first injection packer 46 and a second injection packer 48 serve to isolate the injection region 50 from the production region 52 of the annulus 42. Gas and fluids enter system 10 at a plurality of perforations 54.

As indicated, system 10 enables the disposal of produced fluids from other wells in the field by disposing of the power fluid used to power/operate the pump at the same time with the produced water from the well. The ratio is typically two barrels of power fluid produced water from other wells, for each barrel of produced water from the formation of the equipped well. As may be appreciated, the use of this process on a pad of wells has the potential to be very beneficial with both artificial lift costs as well as disposal of produced water costs. A single surface power fluid unit can run several individual well pumps at the same location. A ten well pad is exemplary.

Figure 2:
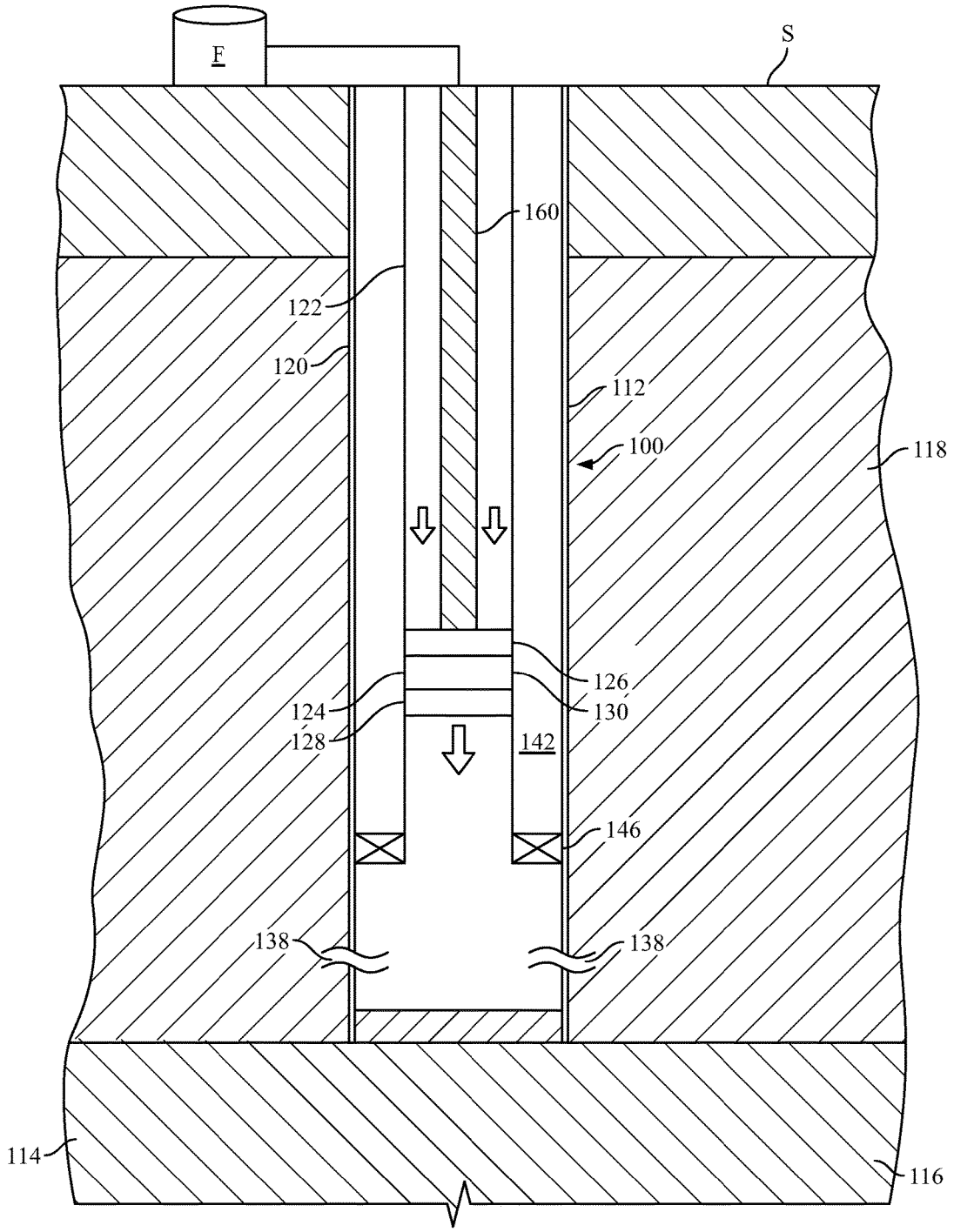
FIG. 2 presents a schematic view of another illustrative, nonexclusive example of a system for disposing of fluids produced from a wellbore, according to the present disclosure.

Referring now to FIG. 2, a schematic view of another system 100 for disposing of fluids produced from a wellbore 112, in accordance with the present disclosure is presented for illustrative purposes. As shown, wellbore 112 extends into a subsurface formation 114, the subsurface formation 114 having a production zone 116 and a disposal zone 118, at least a portion of the wellbore 112 lined with a string of production casing 120.

In some embodiments, system 100 includes a wellbore tubular conduit 122, the wellbore tubular conduit 122 positioned within the casing 120, as shown. In some embodiments, the wellbore tubular conduit 122 may serve as injection tubing. System 100 also includes a pump 124 having an inlet 126 and a discharge 128. As shown, the pump 124 may be structured and arranged so as to be in fluid communication with the wellbore tubular conduit 122. As shown, a primary source of produced fluids F is in fluid communication with the inlet 126 of the pump 124.

A driver 130 is operatively connected to the pump 124 for driving the pump 124. In some embodiments, the driver 130 comprises electrically driven solid state electronics or an electric motor. In some embodiments, a cable or power cord 160 for supplying electricity to the driver 130 is provided. In some embodiments, system 100 further may include a power source (not shown) that is configured to provide an electric current to cable or power cord 160 for powering driver 130 of pump 124.

In some embodiments, the pump 124 is sized for placement and operation within the wellbore tubular conduit 122, the pump 124 having sufficient pressure to inject into the disposal zone. 118. In some embodiments, the pump 124 is structured and arranged to return to the surface S for service by pulling the cable or power cord 160.

System 100 also includes a first plurality of perforations 138 positioned about the production casing 120, the plurality of perforations 138 in fluid communication with the discharge 128 of the pump 124. As may be appreciated from a review of FIG. 2, the plurality of perforations 138 provides a pathway for injecting the primary produced fluids F into the disposal zone 118. In some embodiments, the disposal zone 118 is above or below the production zone 116. Although not shown, but will be appreciated by those skilled in the art, the system 100 possesses utility in wellbores wherein at least a portion of the wellbore is completed along the subsurface formation in a horizontal orientation.

In some embodiments, a first injection packer 146 may be employed, as shown. In some embodiments, the source of produced fluids F is obtained from a plurality of wellbores extending into the subsurface formation 114.

Figure 3:
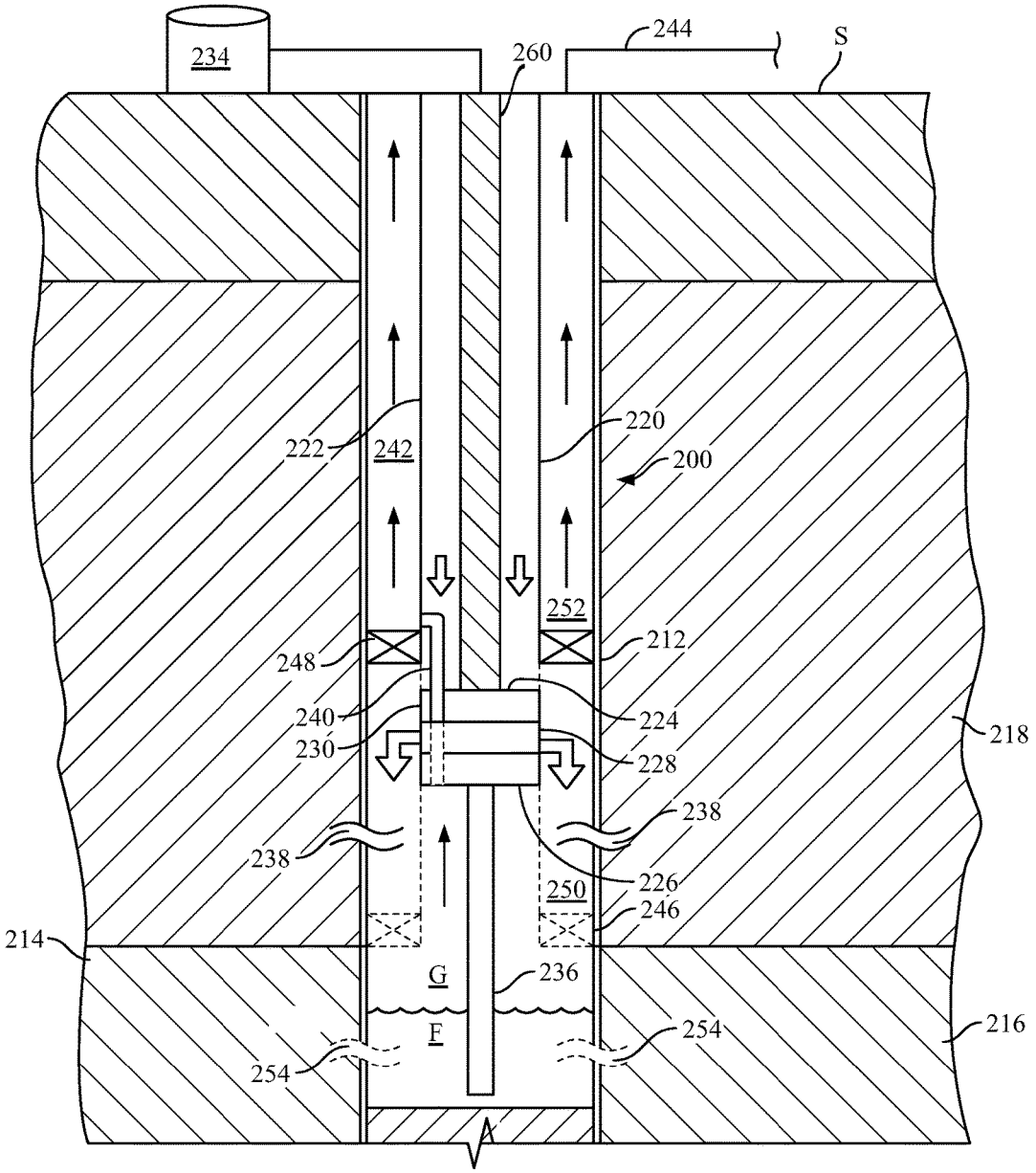
FIG. 3 presents a schematic view of yet another illustrative, nonexclusive example of a system for disposing of fluids produced from a wellbore, according to the present disclosure.

FIG. 3 presents, for illustrative purposes, yet another schematic view of a system 200 for disposing of fluids produced from a wellbore 212, in accordance with the present disclosure. As shown, wellbore 212 extends into a subsurface formation 214, the subsurface formation 214 having a production zone 216 and a disposal zone 218, at least a portion of the wellbore 212 lined with a string of production casing 220.

In some embodiments, system 200 includes a wellbore tubular conduit 222, the wellbore tubular conduit 222 positioned within the casing 220, as shown. In some embodiments, the wellbore tubular conduit 222 may serve as injection tubing. System 200 also includes a pump 224 having an inlet 226 and a discharge 228. As shown, the pump 224 may be structured and arranged so as to be in fluid communication with the wellbore tubular conduit 222. A driver 230 is operatively connected to the pump 224 for driving the pump 224. As shown, a primary source of produced fluids F is in fluid communication with the inlet 226 of the pump 224. In some embodiments, a dip tube 236 is employed to place inlet 226 in fluid communication with the primary source of produced fluids F.

In some embodiments, the driver 230 comprises electrically driven solid state electronics or an electric motor. In some embodiments, a cable or power cord 260 for supplying electricity to the driver 230 is provided. In some embodiments, system 200 further may include a power source (not shown) that is configured to provide an electric current to cable or power cord 260 for powering driver 230 of pump 224.

In some embodiments, the pump 224 is sized for placement and operation within the wellbore tubular conduit 222, the pump 224 having sufficient pressure to inject into the disposal zone. 218. In some embodiments, the pump 224 is structured and arranged to return to the surface S for service by pulling the cable or power cord 260.

System 200 also includes a first plurality of perforations 238 positioned about the production casing 220, the plurality of perforations 238 in fluid communication with the discharge 228 of the pump 224. As may be appreciated from a review of FIG. 3, the plurality of perforations 238 provides a pathway for injecting the primary produced fluids F into the disposal zone 218. Advantageously, system 200 may also be configured so that a secondary source of produced fluids 234 may also be injecting into the disposal zone 218 through the plurality of perforations 238.

In some embodiments, the disposal zone 218 is above or below the production zone 216. Although not shown, but will be appreciated by those skilled in the art, the system 200 possesses utility in wellbores wherein at least a portion of the wellbore is completed along the subsurface formation in a horizontal orientation.

As may be appreciated, in some embodiments, both the production and injection or disposal of fluids may be carried out in the same horizontal orientation. An exemplary embodiment may encompass one or more horizontal well sections of up to about 3050 meters (about 10,000 feet) or more in length. By way of example, but not of limitation, if a toe down well are structured and arranged to encompass disposal at the toe and production at the heal, it would have the appearance or configuration of two vertical wells of up to about 3050 meters (about 10,000 feet) or more apart.

For the purposes of this disclosure, the use of the terms "production zone" and "disposal zone" may also encompass production and pressure support within the production zone.

Gas G produced from wellbore 212 enters inlet 226 of pump 224 and is discharged through gas discharge tube 240, through annulus 242, exiting wellbore 212 through gas conduit 244.

In some embodiments, system 200 further may include a sand control structure (not shown), which may be configured to limit the flow of sand into inlet 226 of pump 224.

In some embodiments, a first injection packer 246 and a second injection packer 248 serve to isolate the injection region 250 from the production region 252 of the annulus 242. Gas and fluids enter system 200 at a plurality of perforations 254.

Figure 4:
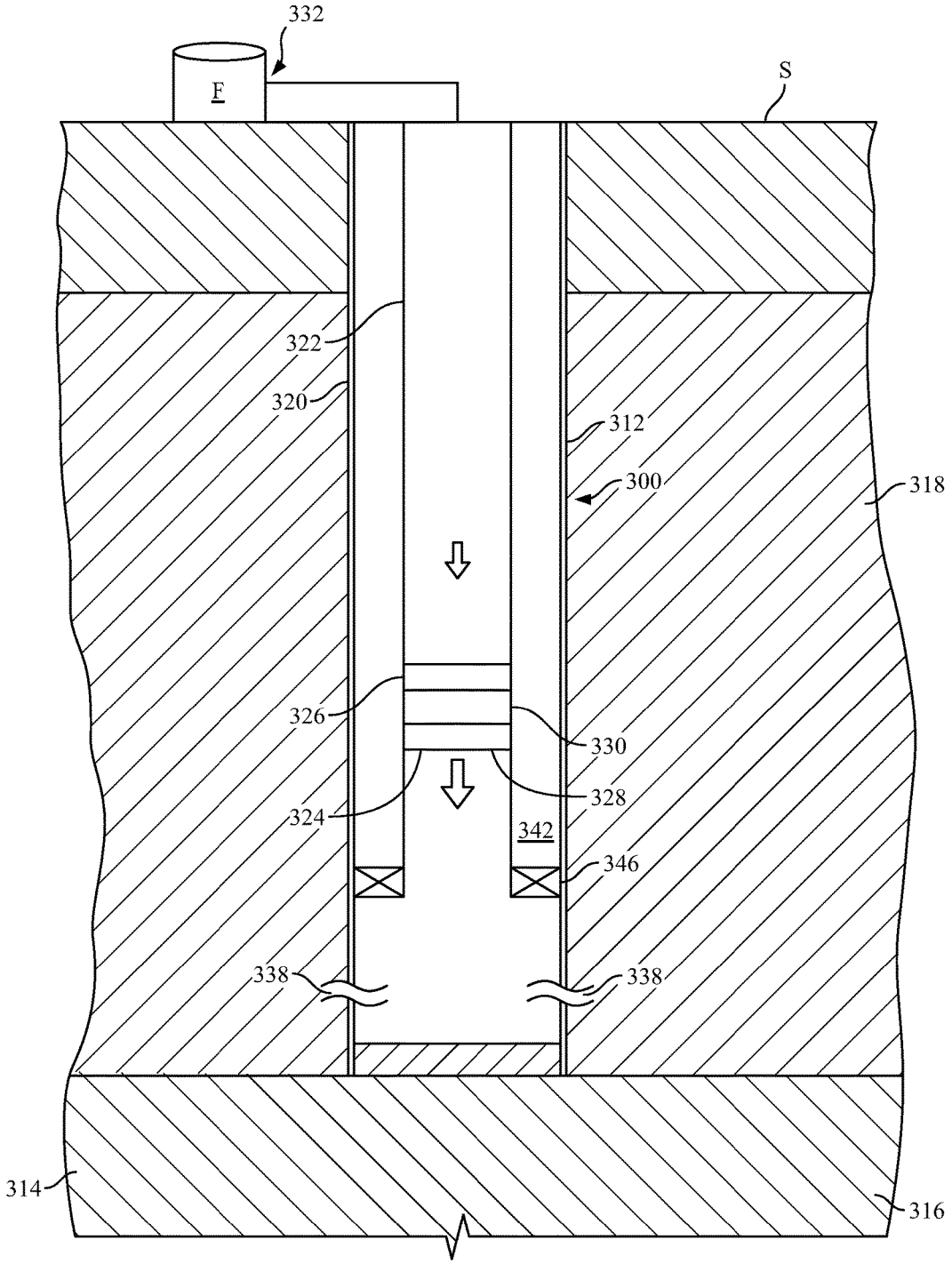
FIG. 4 presents a schematic view of still another illustrative, nonexclusive example of a system for disposing of fluids produced from a wellbore, according to the present disclosure.

Referring now to FIG. 4, a schematic view of another system 300 for disposing of fluids produced from a wellbore 312, in accordance with the present disclosure is presented for illustrative purposes. As shown, wellbore 312 extends into a subsurface formation 314, the subsurface formation 314 having a production zone 316 and a disposal zone 318, at least a portion of the wellbore 312 lined with a string of production casing 320.

In some embodiments, system 300 includes a wellbore tubular conduit 322, the wellbore tubular conduit 322 positioned within the casing 320, as shown. In some embodiments, the wellbore tubular conduit 322 may serve as injection tubing. System 300 also includes a pump 324 having an inlet 326 and a discharge 328. As shown, the pump 324 may be structured and arranged so as to be in fluid communication with the wellbore tubular conduit 322. As shown, a primary source of produced fluids F is in fluid communication with the inlet 326 of the pump 324.

A driver 330 is operatively connected to the pump 324 for driving the pump 324. In some embodiments, the driver 330 of pump 324 may be a hydraulic driver, which is powered by a system 332 comprising the primary source of produced fluids F, the primary source of produced fluids F produced at least in part by one or more other wells of the subterranean formation 314.

In some embodiments, the pump 324 is sized for placement and operation within the wellbore tubular conduit 322, the pump 324 having sufficient pressure to inject into the disposal zone. 318. In some embodiments, the pump 324 is structured and arranged to return the pump 324 to the surface S by hydraulic pressure for service. In some embodiments, the hydraulic pressure is provided from the primary source of produced fluids F.

System 300 also includes a first plurality of perforations 338 positioned about the production casing 320, the plurality of perforations 338 in fluid communication with the discharge 328 of the pump 324. As may be appreciated from a review of FIG. 4, the plurality of perforations 338 provides a pathway for injecting the primary produced fluids F into the disposal zone 318. In some embodiments, the disposal zone 318 is above or below the production zone 316. Although not shown, but will be appreciated by those skilled in the art, the system 300 possesses utility in wellbores wherein at least a portion of the wellbore is completed along the subsurface formation in a horizontal orientation.

In some embodiments, a first injection packer 346 may be employed, as shown. In some embodiments, the source of produced fluids F is obtained from a plurality of wellbores extending into the subsurface formation 314.

Referring to FIGS. 1-4, wellbore tubular conduit 22, 122, 222, or 322 may have a seat attached thereto and/or included therein, the seat configured to receive pump 24, 124, 224, or 324 and/or to retain pump 24, 124, 224, or 324 at, or within, a desired region and/or location. Additionally or alternatively, pump 24, 124, 224, or 324 may include and/or be operatively attached to a packer. The packer may be configured to swell or otherwise be expanded within wellbore tubular conduit 22, 122, 222, or 322 and to thereby retain pump 24, 124, 224, or 324 at, or within, the desired region and/or location within wellbore tubular conduit 22, 122, 222, or 322.

A sensor may be configured to detect a downhole process parameter and may be located anywhere within wellbore 12, 112, 212, or 312, may be operatively attached to pump 24, 124, 224, or 324, and/or may form a portion of the pump 24, 124, 224, or 324. The sensor may be configured to convey a data signal that is indicative of the process parameter to surface region S and/or may be in communication with a controller that is configured to control the operation of at least a portion of downhole pump 24, 124, 224, or 324.

The sensor may include any suitable structure that is configured to detect a downhole process parameter. Illustrative, non-exclusive examples of the downhole process parameter include a downhole temperature, a downhole pressure, a discharge pressure from the pump 24, 124, 224, or 324, a downhole flow rate, and/or a discharge flow rate from the pump 24, 124, 224, or 324.

It is within the scope of the present disclosure that the sensor may be configured to detect the downhole process parameter at any suitable location within wellbore 12, 112, 212, or 312. As an illustrative, non-exclusive example, the sensor may be located such that the downhole process parameter is indicative of a condition at an inlet 26, 126, 226, or 326 to pump 24, 124, 224, or 324. As another illustrative, non-exclusive example, the sensor may be located such that the downhole process parameter is indicative of a condition at an outlet 28, 128, 228, or 328 from pump 24, 124, 224, or 324.

When system 10, 100, 200 or 300 includes an optional sensor, the system also may include a data communication conduit that may be configured to convey a signal that is indicative of the downhole process parameter between sensor and the surface S. As an illustrative, non-exclusive example, the controller may be located at surface S, and the data communication conduit may convey the signal to the controller. As another illustrative, non-exclusive example, the data communication conduit may convey the signal to a display and/or to a terminal that is located at surface S.

As indicated, suitable pumps include hydraulically powered pumps, micro positive displacement pumps and solid state pumps. A source of hydraulically powered pumps having utility in the practice of the present disclosure includes those produced by Cormorant Engineering of New Waverly, Tex., USA. In particular, the Cormorant SRP (Self Reciprocating Pump) hydraulic pump may be employed in the systems disclosed in FIGS. 1 and 4.

The Cormorant SRP hydraulic pump is a dual action pump having a switching directional valve incorporated therein. Since the Cormorant SRP design compresses the fluid column with each stroke, timing and efficiency losses are minimized. Capacities of 100 BPD and depths to 5000 m TVD can be achieved with this pump.

Micro-pumps can be grouped into mechanical and non-mechanical devices: Mechanical systems contain moving parts, which are usually actuation and valve membranes or flaps. The driving force can be generated by utilizing piezoelectric, electrostatic, thermo-pneumatic, pneumatic or magnetic effects. Non-mechanical pumps function with electrohydrodynamic, electro-osmotic, electrochemical or ultrasonic flow generation.

Piezoelectric pumps for downhole applications may operate as positive displacement pumps and thus may be sized, designed, and/or configured to generate pressurized wellbore liquid at a pressure that is sufficient to permit the pressurized wellbore liquid to be conveyed without utilizing a large number of pumping stages. It follows that reducing the number of pumping stages may decrease the length of a downhole piezoelectric pump. As illustrative, non-exclusive examples, a piezoelectric pump, in accordance herewith, may include fewer than five stages, fewer than four stages, fewer than three stages, or a single stage.

Piezoelectric pumps include a piezoelectric element and a compression chamber. The piezoelectric element may be configured to selectively and/or repeatedly transition from an extended state to a contracted state during an intake stroke of the piezoelectric pump and to subsequently transition from the contracted state to the expanded state during an exhaust stroke. This may include transitioning between the extended state and the contracted state responsive to receipt of electric current, which may be AC electric current.

The compression chamber is configured to receive produced fluids from the wellbore, via an inlet, during the intake stroke of the piezoelectric pump and to emit, or discharge, pressurized fluids through an outlet, during the exhaust stroke of the piezoelectric pump.

The reduced length and/or small diameter of the pumps disclosed herein permit the pumps to be located within and/or to flow through and/or past deviated regions within a wellbore and/or wellbore tubular conduit. These deviated regions might obstruct and/or retain longer and/or larger-diameter traditional pumping systems that do not include the pumps disclosed herein. Thus, the pumps according to the present disclosure may be operable in hydrocarbon wells that are otherwise inaccessible to more traditional artificial lift systems.

Additionally or alternatively, the small length and/or the small diameter of pumps according to the present disclosure permit the pumps to be located within a wellbore tubular conduit and/or removed from a wellbore tubular conduit using a lubricator. This permits the pumps disclosed herein to be located within the wellbore tubular conduit without depressurizing the well, without killing the well, without first supplying a kill weight fluid to the wellbore, and/or while containing wellbore fluids within the wellbore. This may increase an overall efficiency of operations that insert the pumps into and/or remove the pumps from the wellbore, may decrease a time required to permit the pumps to be inserted into and/or removed from wellbore, and/or may decrease a potential for damage to the well when the pumps are inserted into and/or removed from the wellbore.

Figure 5:
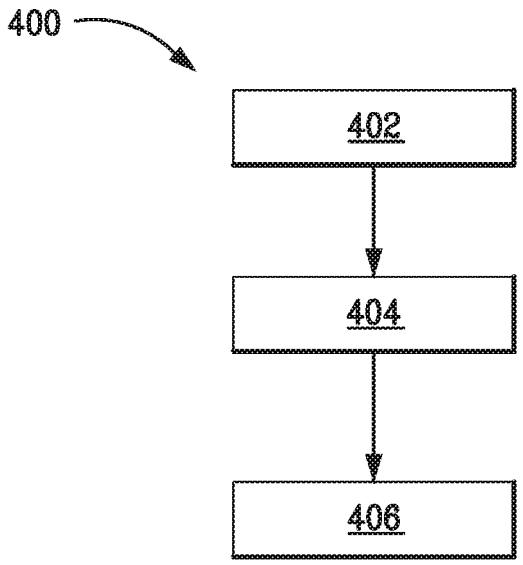
FIG. 5 presents a method for disposing of fluids produced from a wellbore, according to the present disclosure.

Referring now to FIG. 5, in another aspect, disclosed herein is a method of disposing of fluids produced from a wellbore extending into a subsurface formation 400, the subsurface formation having a production zone and a disposal zone, at least a portion of the wellbore lined with a string of production casing. The method includes 402, placing a wellbore tubular conduit within the casing; 404, placing a pump in fluid communication with the wellbore tubular conduit, the pump having an inlet and a discharge, the inlet in fluid communication with a source of produced fluids; and 406 injecting the produced fluids through a plurality of perforations positioned about the casing into a disposal zone of the subsurface formation.

In some embodiments, the disposal zone is above or below the production zone. In some embodiments, at least a portion of the wellbore is completed along the subsurface formation in a horizontal orientation.

In some embodiments, the pump is sized for placement and operation within the wellbore tubular conduit. In some embodiments, the method further includes providing sufficient pressure to inject into the disposal zone.

In some embodiments, the method further includes powering the pump with a system comprising electrically driven solid state electronics or an electric motor. In some embodiments, the method further includes returning the pump to the surface for service by pulling a cable or power cord that supplies electricity to it.

In some embodiments, the method further includes powering the pump by a system comprising the source of produced fluids. In some embodiments, the method further includes returning the pump to the surface for service by hydraulic pressure. In some embodiments, the hydraulic pressure is provided from the source of produced fluids. In some embodiments, the source of produced fluids is obtained from a plurality of wellbores extending into the subsurface formation.

As may be appreciated from the above, the benefits of the systems and methods disclosed herein may include reduced spill potential, since much of the produced water never reaches the surface. With a pad application, most of the produced water would not leave the site. Significant chemical reductions may be enjoyed since the corrosive produced water is not returned to the surface and scaling tendencies may be reduced or eliminated.

While it may appear that a downside to the system and methods disclosed herein may be the lack of separation to recover hydrocarbon liquids, such as the condensate that may be produced. Most gas wells of the type contemplated, however, do not produce enough condensate to economically justify the lifting costs associated with recovery. If economically justified, the pump or pumps could dispose of undesired produced water after separation. A separation device may also be deployed downhole, providing a gross cut between water and hydrocarbon fluids that could then be directed back to surface or disposed of, as desired.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

Illustrative, non-exclusive examples of systems and methods according to the present disclosure have been presented above. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of disposing of fluids produced from a wellbore extending from a wellbore surface into a subsurface formation, the subsurface formation having a production zone and a disposal zone, at least a portion of the wellbore lined with a string of casing, comprising:

placing a wellbore tubular conduit within the casing forming an annulus between the tubular conduit and the casing:

placing a pump in fluid communication with the wellbore tubular conduit, the pump having an inlet and a discharge, the inlet in fluid communication with a source of produced fluids; and injecting the produced fluids through a plurality of perforations positioned about the casing into a disposal zone of the subsurface formation using the pump, without pumping any of the produced fluids to the surface;

powering the pump only for injecting the produced fluids into the disposal zone; and producing gas from the formation through the annulus to the wellbore surface using subsurface formation pressure while injecting the produced fluids.

2. The method of claim 1, wherein the disposal zone is above or below the production zone.

3. The method of claim 1, wherein at least a portion of the wellbore is completed along the subsurface formation in a horizontal orientation and forms a horizontal production zone.

4. The method of claim 3, wherein the disposal zone is within the horizontal production zone.

5. The method of claim 1, wherein the pump is sized for placement and operation within the wellbore tubular conduit.

6. The method of claim 5, further comprising providing sufficient pressure to inject into the disposal zone.

7. The method of claim 1, further comprising powering the pump with a system comprising electrically driven solid state electronics or an electric motor.

8. The method of claim 7, further comprising returning the pump to the surface for service by pulling a cable or power cord that supplies electricity to it.

9. The method of claim 1, further comprising powering the pump by a system comprising the source of produced fluids.

10. The method of claim 9, further comprising returning the pump to the surface for service by hydraulic pressure.

11. The method of claim 10, wherein hydraulic pressure is provided from the source of produced fluids.

12. The method of claim 1, wherein the source of produced fluids is obtained from a plurality of wellbores extending into the subsurface formation.

13. The method of claim 1, wherein the pump is selected from a micro positive displacement pump, a solid state pump or a hydraulically powered pump.

14. A system for disposing of fluids produced from a wellbore extending from a wellbore surface into a subsurface formation, the subsurface formation having a production zone and a disposal zone, at least a portion of the wellbore lined with a string of casing, comprising:

a) a wellbore tubular conduit, the wellbore tubular conduit positioned within the casing forming an annulus between the tubular conduit and the casing:

b) a pump having an inlet and a discharge, the pump in fluid communication with the wellbore tubular conduit;

c) a driver operatively connected to the pump for driving the pump;

d) a source of produced fluids within the casing in fluid communication with the inlet of the pump; and e) a plurality of perforations positioned about the casing, the plurality of perforations in fluid communication with the discharge of the pump, the plurality of perforations providing a pathway for injecting produced fluids into the disposal zone, f) injecting the produced fluids through a plurality of perforations positioned about the casing into a disposal zone of the subsurface formation using the pump for the injecting, without pumping any of the produced fluids to the surface, powering the pump only for injecting the produced fluids into the disposal zone; and g) producing gas from the formation through the annulus to the wellbore surface while injecting the produced fluids, using subsurface formation pressure.

15. The system of claim 14, wherein the disposal zone is above or below the production zone.

16. The system of claim 14, wherein at least a portion of the wellbore is completed along the subsurface formation in a horizontal orientation and forms a horizontal production zone.

17. The system of claim 16, wherein the disposal zone is within the horizontal production zone.

18. The system of claim 14, wherein the pump is sized for placement and operation within the wellbore tubular conduit, the pump having sufficient pressure to inject into the disposal zone.

19. The system of claim 14, wherein the pump is powered by a system comprising electrically driven solid state electronics or an electric motor.

20. The system of claim 19, further comprising a cable or power cord for supplying electricity to the pump, the pump structured and arranged to return to the surface for service by pulling the cable or power cord.

21. The system of claim 14, wherein the pump is powered by a system comprising the source of produced fluids.

22. The system of claim 21, wherein the pump is structured and arranged to return the pump to the surface for service by hydraulic pressure.

23. The system of claim 22, wherein hydraulic pressure is provided from the source of produced fluids.

24. The system of claim 14, wherein the source of produced fluids is obtained from a plurality of wellbores extending into the subsurface formation.

25. The system of claim 14, wherein the pump is selected from a micro positive displacement pump, a solid state pump or a hydraulically powered pump.

* * * * *